US009687968B2

(12) United States Patent
Doroslovac et al.

(10) Patent No.: US 9,687,968 B2
(45) Date of Patent: Jun. 27, 2017

(54) ANTI-SLIP WRENCH-TYPE TOOL

(71) Applicants: Robert S Doroslovac, Massilon, OH (US); Paul Kukucka, Brandon, FL (US); Thomas Stefan Kukucka, Brandon, FL (US)

(72) Inventors: Robert S Doroslovac, Massilon, OH (US); Paul Kukucka, Brandon, FL (US); Thomas Stefan Kukucka, Brandon, FL (US)

(73) Assignee: GRIP TOOLING TECHNOLOGIES LLC, Brandon, FL (US)

( * ) Notice: Subject to any disclaimer, the term of this patent is extended or adjusted under 35 U.S.C. 154(b) by 0 days.

(21) Appl. No.: 15/278,845

(22) Filed: Sep. 28, 2016

(65) Prior Publication Data

US 2017/0014980 A1 Jan. 19, 2017

Related U.S. Application Data

(63) Continuation-in-part of application No. 29/543,768, filed on Oct. 28, 2015, now Pat. No. Des. 776,505, and a continuation-in-part of application No. 29/551,895, filed on Jan. 18, 2016, and a continuation-in-part of application No. 29/566,336, filed on May 27, 2016, and a continuation-in-part of application No. 29/566,311, filed on May 27, 2016, and a continuation-in-part of application No. 29/564,310, filed on May 12, 2016, and a continuation-in-part of application No. 29/566,463, (Continued)

(51) Int. Cl.

| | |
|---|---|
| ***B25B 13/06*** | (2006.01) |
| ***B25B 13/08*** | (2006.01) |
| ***B25B 27/18*** | (2006.01) |

(52) U.S. Cl.

CPC ..... *B25B 13/065* (2013.01); *B25B 13/08* (2013.01); *B25B 27/18* (2013.01)

(58) Field of Classification Search

CPC ..... B25B 27/18; B25B 13/06; B25B 13/48; B25B 13/5016; B25B 23/103; B25B 27/143

See application file for complete search history.

(56) References Cited

U.S. PATENT DOCUMENTS

| | | | | |
|---|---|---|---|---|
| 7,331,260 | B2 * | 2/2008 | Cheng | B25B 13/04 81/119 |
| 9,415,487 | B2 * | 8/2016 | Wilson | B25B 13/5091 |
| 2008/0245195 | A1 * | 10/2008 | Lee | B25B 13/065 81/124.6 |

* cited by examiner

*Primary Examiner* — Robert Scruggs

(57) ABSTRACT

A wrench-type tool that utilizes a plurality of engagement features to efficiently transfer torque to a fastener in order to rotate said fastener. The wrench-type tool includes a wrench-type torque-tool body. The wrench-type torque-tool body is the physical structure used to apply a torque force onto the fastener and includes a plurality of internal sidewalls and a plurality of engagement teeth. The plurality of internal sidewalls is radially distributed about a pivot axis of the wrench-type torque-tool body. Each of the plurality of engagement teeth is adjacently connected to a corresponding sidewall from the plurality of internals sidewalls in order to directly engage the sidewalls of the fastener. To increase the total contact surface with the fastener, a prismatic altitude for each of the plurality of engagement teeth is aligned parallel to the pivot axis. Furthermore, each of the plurality of engagement teeth is oriented towards the pivot axis.

11 Claims, 10 Drawing Sheets

Related U.S. Application Data filed on May 31, 2016, and a continuation-in-part of application No. 29/566,305, filed on May 27, 2016, and a continuation-in-part of application No. 14/701,482, filed on Apr. 30, 2015, and a continuation-in-part of application No. 29/546,845, filed on Nov. 25, 2015, now abandoned, and a continuation-in-part of application No. 29/546,846, filed on Nov. 25, 2015, now abandoned.

(60) Provisional application No. 62/328,102, filed on Apr. 27, 2016, provisional application No. 61/986,327, filed on Apr. 30, 2014, provisional application No. 62/323,895, filed on Apr. 18, 2016.

SECTION A-A

DETAIL Y

SECTION A-A

DETAIL X

ANTI-SLIP WRENCH-TYPE TOOL

FIELD OF THE INVENTION

The present invention relates generally to tools designed for tightening or loosening fasteners, in particular bolts and nuts. More specifically, the present invention is an anti-slip wrench-type tool designed to engaged bolts, nuts, and other similar fasteners with little chance of slippage.

BACKGROUND OF THE INVENTION

Hex bolts, nuts, screws, and other similar threaded devices are used to secure and hold multiple parts together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, binding the associated components together. The head is the means by which the fastener is turned, or driven, into the female threading. The head is shaped specifically to allow an external tool like a wrench to apply a torque to the fastener in order to rotate the fastener and engage the complimentary female threading to a certain degree. This type of fastener is simple, extremely effective, cheap, and highly popular in modern construction.

One of the most common problems in using these types of fasteners, whether male or female, is the tool slipping in the head portion, or slipping on the head portion. This is generally caused by either a worn fastener or tool, corrosion, overtightening, and damage to the head portion of the fastener. The present invention is a wrench or wrench socket design that virtually eliminates slippage. The design utilizes a plurality of engagement teeth which efficiently transitions the contact point from the corners of the fastener to the sidewalls of the fastener, allowing for torque to be applied to the fastener in order to loosen it. The present invention may be used to tighten or loosen fasteners without worrying about stripping the corners of the fastener.

DETAIL DESCRIPTIONS OF THE INVENTION

All illustrations of the drawings are for the purpose of describing selected versions of the present invention and are not intended to limit the scope of the present invention.

The present invention is an anti-slip wrench-type tool used to tighten or loosen a fastener such as a nut or bolt. Traditional wrench designs transfer the majority of the torque to the fastener through the lateral corners of the fastener head. Over time, the degradation of the lateral corners reduces the efficiency of transferring torque from the wrench to the fastener head and, as a result, causes slippage. The present invention overcomes this problem by moving the contact point to the lateral sides of the fastener head. This is accomplished through the use of a multitude of teeth. Each of the teeth is positioned to engage or "bite" the lateral surface of the fastener head instead of the lateral corner. This ensures an adequate amount of torque is transferred to the fastener head to initiate rotation and, resultantly, extraction or tighten the fastener.

The present invention utilizes a multitude of teeth to engage the sides of the fastener head, damaged or otherwise, in order to efficiently apply torque onto the fastener. The present invention may be integrated into or utilized by a variety of general tools to increase the torque force applied to a fastener. General tools include, but are not limited to, open-end wrenches, adjustable wrenches, pipe wrenches, socket wrenches, plumber wrench, and other similar fastener engaging tools. The present invention is compatible with male-member based head designs of fasteners. Fasteners which utilize a male-member head design, also known as male fasteners, use the external lateral surface of the fastener head to engage a tool for tightening or loosening, such fasteners include hex bolts and nuts. In addition, the present invention is compatible with fasteners of a right-hand thread and fasteners of a left-hand thread. Furthermore, the present invention may be altered and configured to fit different types and different sizes of fasteners.

Figure 1:
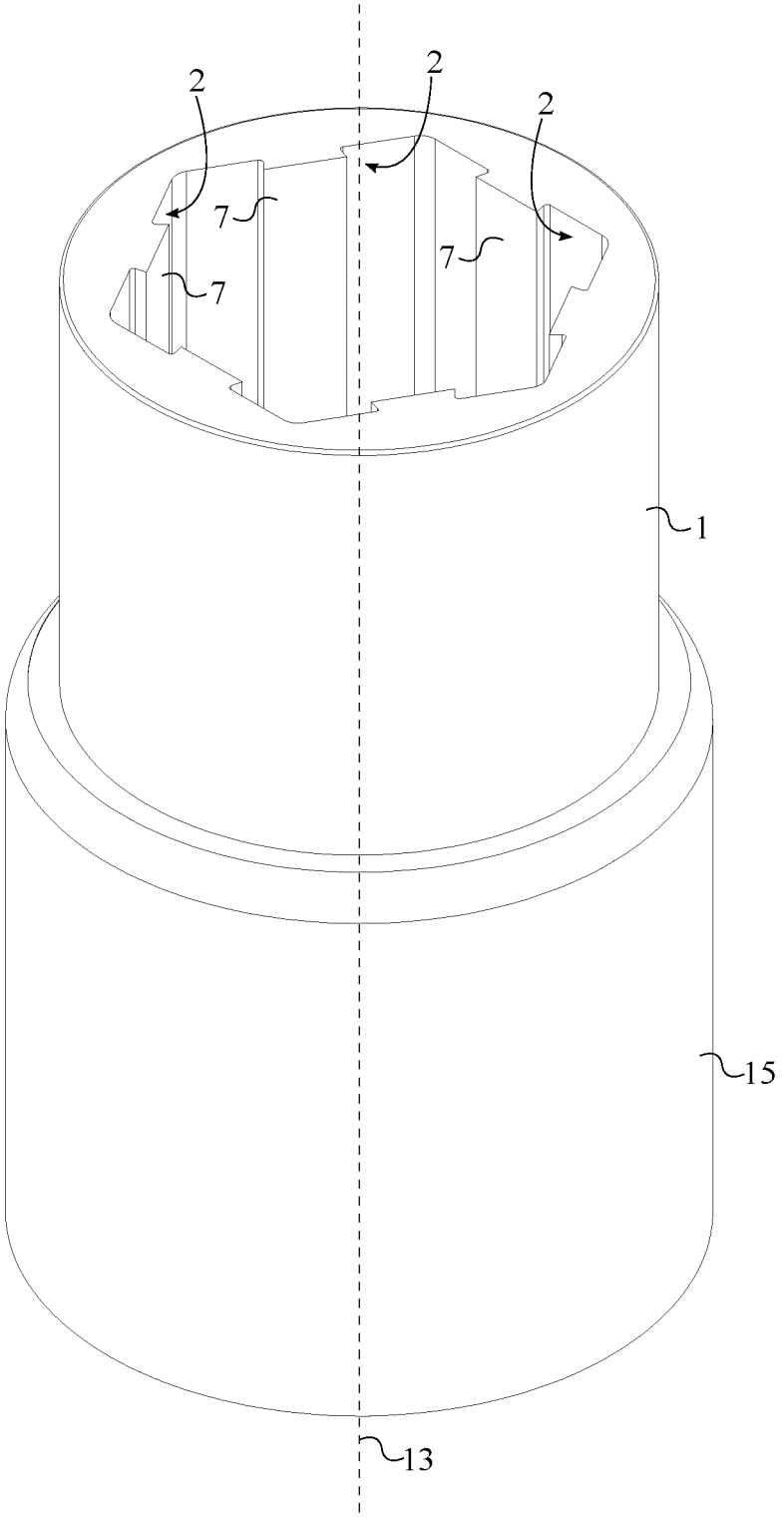
FIG. 1 is a perspective view of the present invention.
Figure 4:
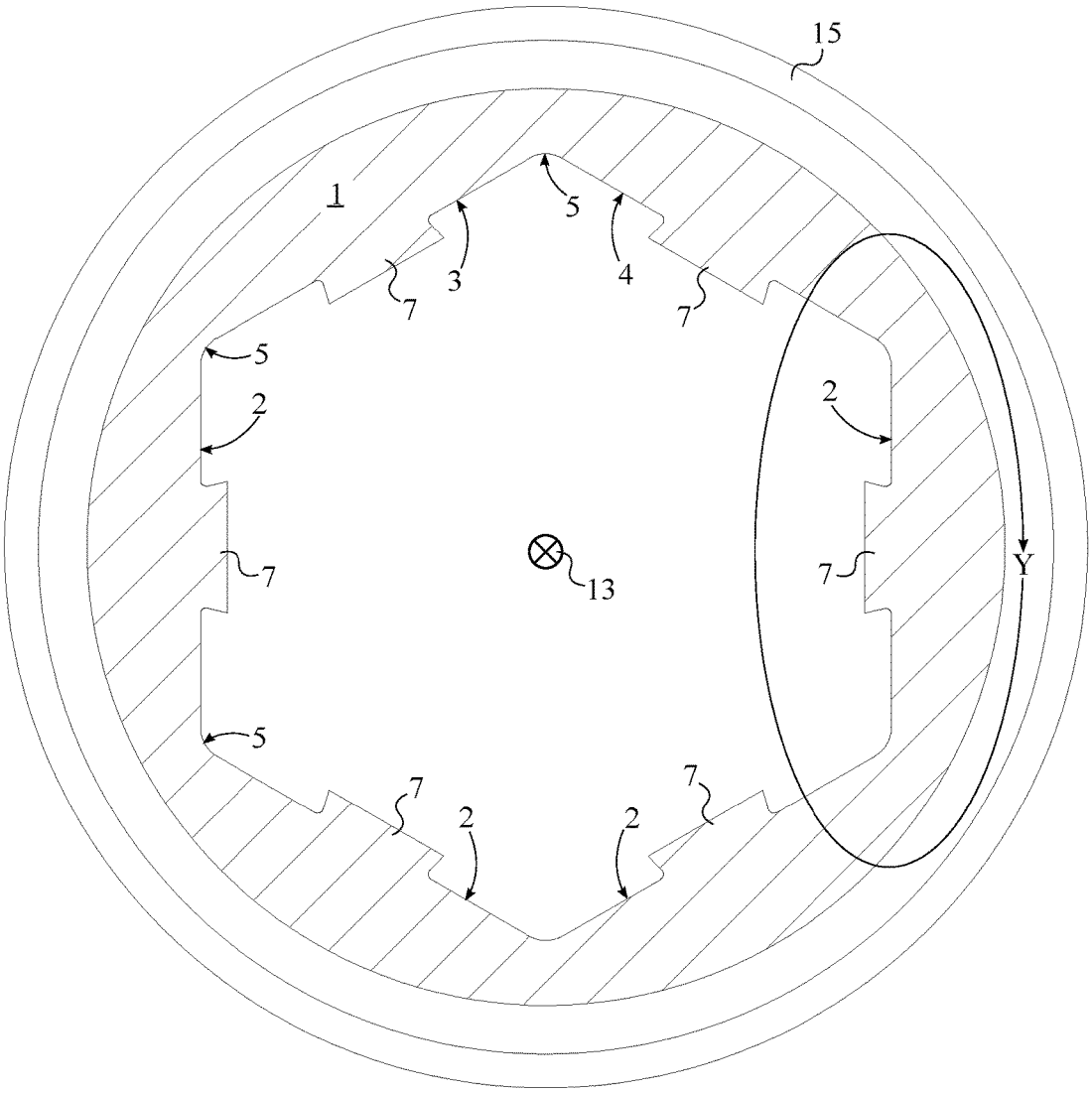
FIG. 4 is a sectional view of the present invention taken along line A-A in FIG. 3.

Referring to FIG. 1, the present invention comprises a wrench-type torque-tool body 1. The wrench-type torque-tool body 1 is used as the physical structure to apply a torque force onto the fastener head. In particular, the wrench-type torque-tool body 1 is a tubular extrusion sized to fit over the male fastener in an interlocking manner, essentially a wrench socket. The length, width, and diameter of the wrench-type torque-tool body 1 may vary to fit different sized fasteners. The wrench-type torque-tool body 1 comprises a plurality of internal sidewalls 2 and a plurality of engagement teeth 7. The plurality of internal sidewalls 2 is radially distributed about a pivot axis 13 of the wrench-type torque-tool body 1 in order delineate a cavity which receives the fastener head. In the preferred embodiment of the present invention, the plurality of internal sidewalls 2 includes six sidewalls configured into a hexagonal shape as seen in FIG. 4. Alternative number within the plurality of internal sidewalls 2 may be used to produce different shapes. The plurality of engagement teeth 7 prevents slippage between the wrench-type torque-tool body 1 and the fastener being engaged. Traditional wrench-type tools utilize the corners of the fastener head as the contact point in order to transmit torque to the fastener. Through the plurality of engagement teeth 7, the present invention effectively transitions the contact point from the corners to the sidewalls of the fastener head. This greatly diminishes any chance of slippage and allows the user to efficiently apply a torque force to the fastener. Additionally, positioning the contact point to the sidewalls of the fastener head prevents the fastener head from stripping.

Figure 5:
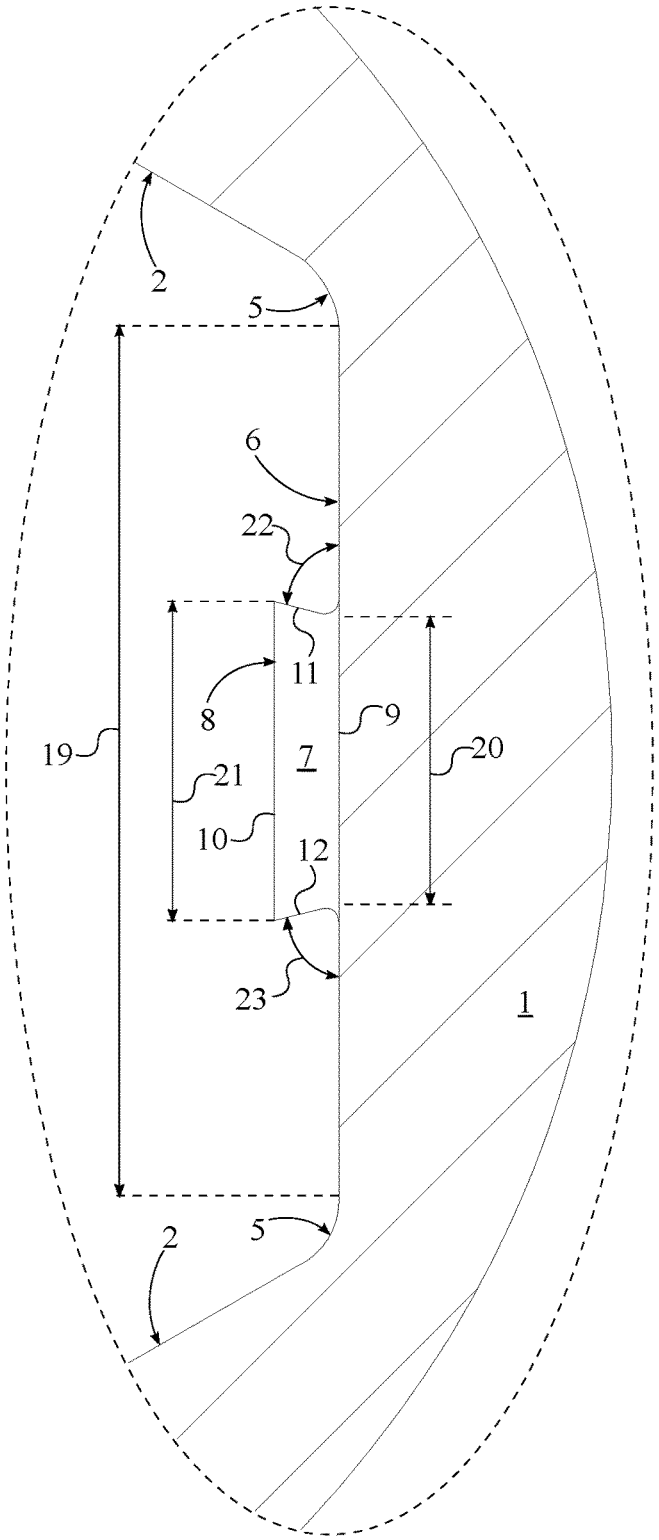
FIG. 5 is a detailed view of the present invention taken about the oval Y in FIG. 4.
Figure 6:
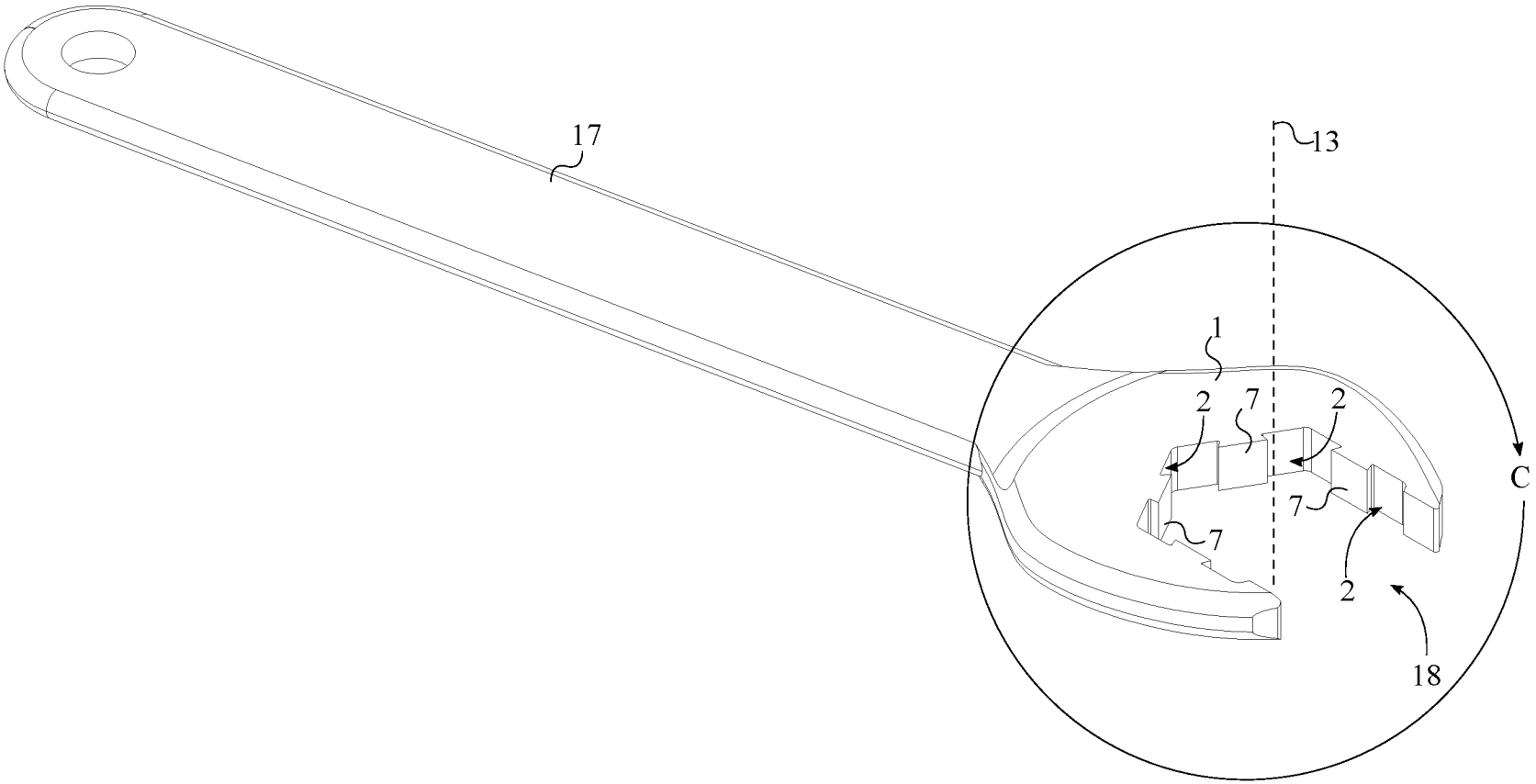
FIG. 6 is a perspective view of an alternative embodiment of the present invention.
Figure 7:
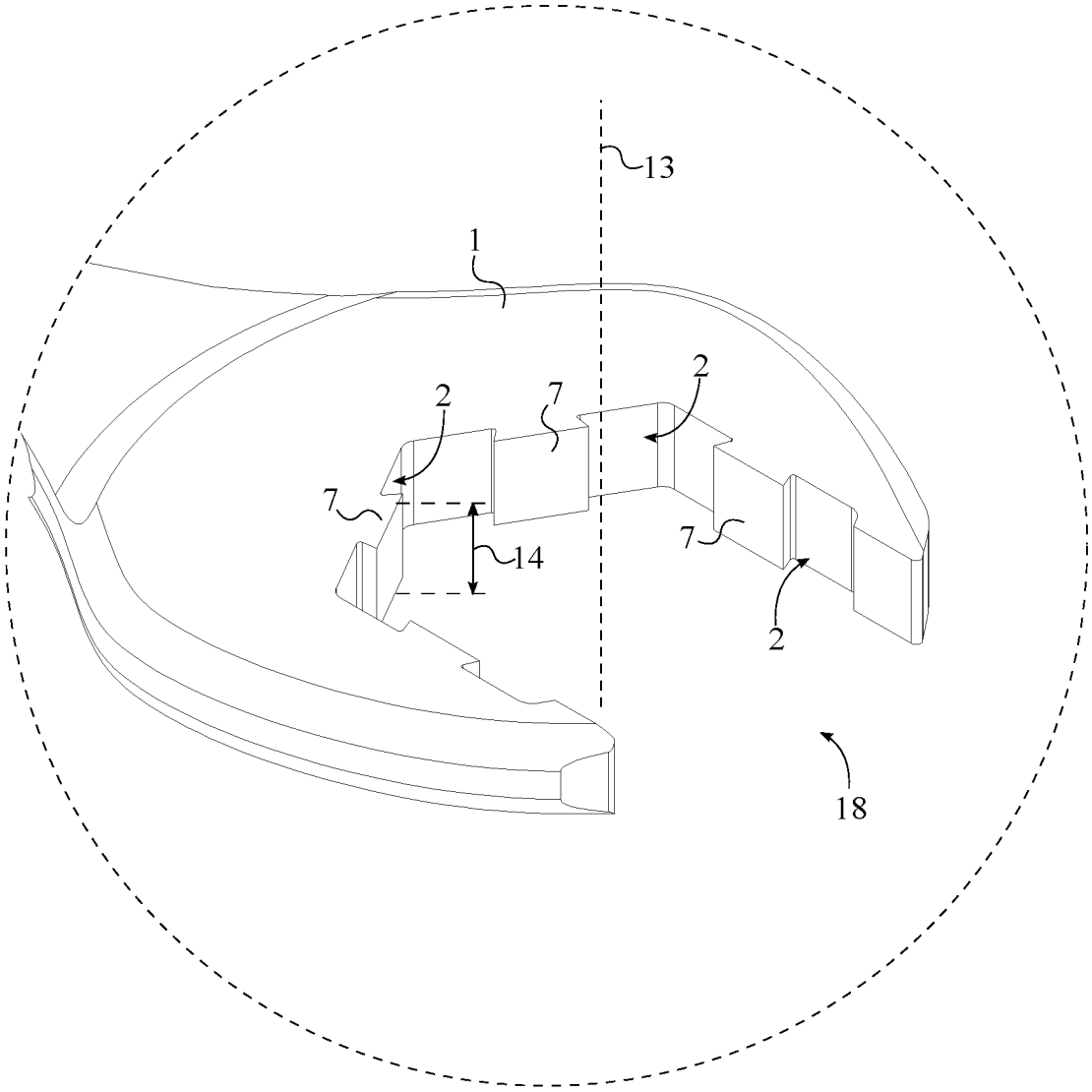
FIG. 7 is a detailed view of the present invention taken about the circle C in FIG. 6.

Referring to FIG. 4 and FIG. 5, each of the plurality of engagement teeth 7 is adjacently connected to a corresponding sidewall 6 from the plurality of internal sidewalls 2 and each of the engagement teeth 7 is a prism, wherein the prism includes an altitude. This allows a contact point for the fastener to be at each of the plurality of internal sidewalls 2. Referring to FIG. 7, a prismatic altitude 14 for each of the plurality of engagement teeth 7 is aligned parallel to the pivot axis 13 to increase the amount of contact surface between the present invention and the fastener. In other words, each of the plurality of engagement teeth 7 extends from a top surface to a bottom surface of the wrench-type torque-tool body 1. Additionally, each of the plurality of engagement teeth 7 is oriented towards the pivot axis 13, seen in FIG. 1 and FIG. 6, in order to ensure that the plurality of engagement teeth 7 are the only parts of the present invention that come into contact with the fastener.

Referring to FIG. 5, each of the plurality of engagement teeth 7 is preferably centrally positioned to the corresponding sidewall 6 in order to transition the point of contact from the corners of the fastener to the sidewalls of the fastener. The central positioning between each of the plurality of engagement teeth 7 and the corresponding sidewall 6 allows for the present invention to tighten or loosen the fastener without potentially engaging the corners of the fastener head. A cross section 8 for each of the plurality of engagement teeth 7 is a quadrilateral shape. The quadrilateral shape includes a first base line 9, a second base line 10, a first leg line 11, and a second leg line 12. The first base line 9 is positioned coincident with the corresponding sidewall 6 and serves as the connecting point in between each of the plurality of the engagement teeth and the corresponding sidewall 6. The second base line 10 is positioned parallel and offset to the first base line 9. The first leg line 11 is connected in between the first base line 9 and the second base line 10. Similarly, the second leg line 12 is connected in between the first base line 9 and the second base line 10, opposite the first leg line 11. The quadrilateral shape is preferably symmetric along a central line, wherein the central line is oriented perpendicular to the first base line 9 and is centrally positioned in between the first leg line 11 and the second leg line 12. A symmetrical design ensures that the present invention performs equally when rotating the fastener in a clockwise direction or in a counter clockwise direction.

In one embodiment of the present invention, the quadrilateral shape tapers from the second base line 10 towards the first base line 9 in order to further yield a trapezoidal shape. As a result, the first leg line 11 is oriented at a first acute angle 22 with the corresponding sidewall 6, and the second leg line 12 is oriented at a second acute angle 23 with the corresponding sidewall 6. This creates a sharp corner between the second base line 10 and the first leg line 11 and between the second base line 10 and the second leg line 12. The sharp corners dig into the fastener head and increase the friction in between the present invention and the fastener, thus allowing for a more efficient transfer of torque force. More specifically, a length 19 of the corresponding sidewall 6 and a length 21 of the second base line 10 are at a ratio of three to one with each other to ensure adequate contact surface between the present invention and the fastener. Furthermore, a length 20 of the first base line 9 and the length 21 of the second base line 10 are at a ratio of 1.1 to 1 with each other.

Figure 8:
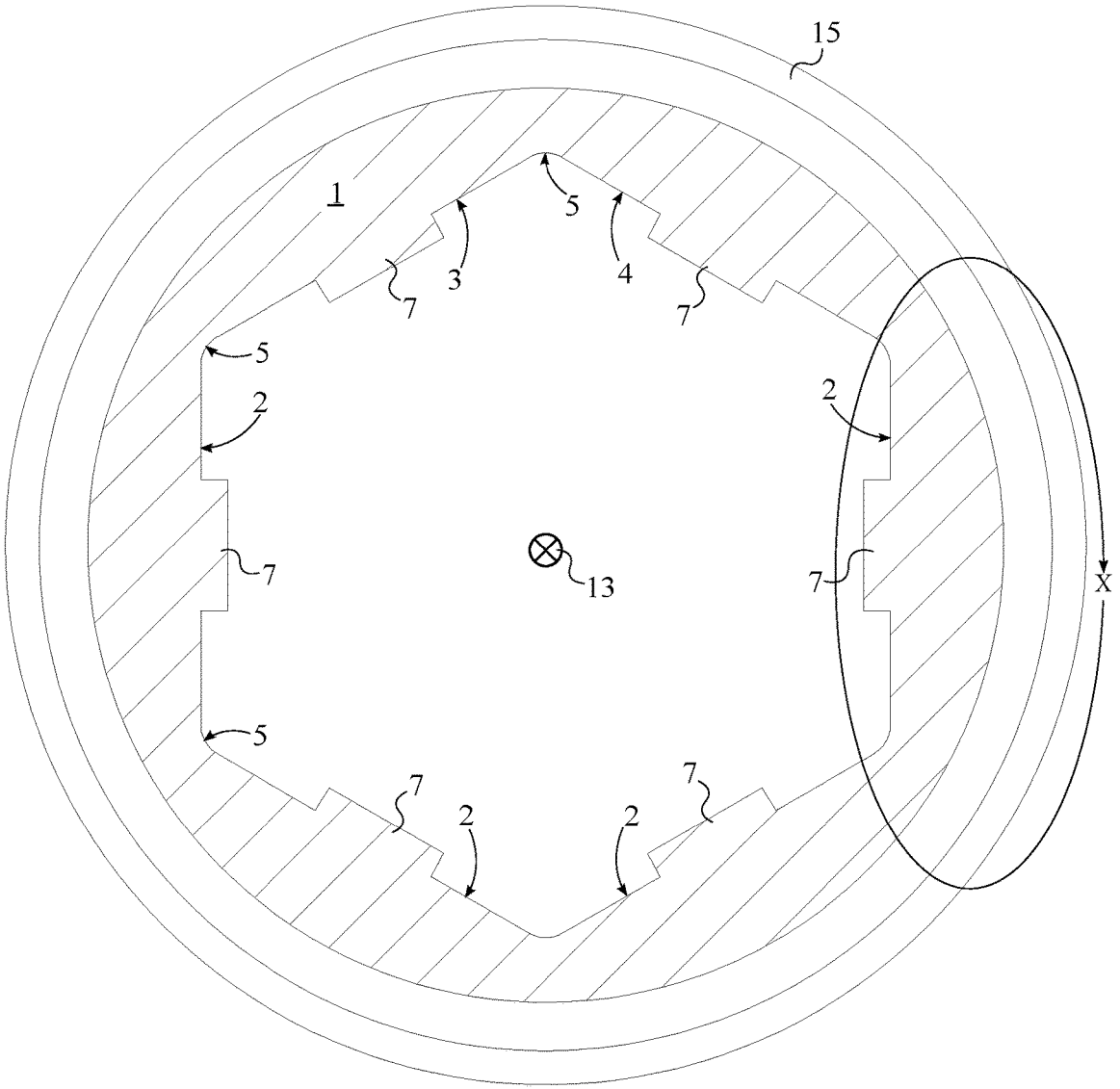
FIG. 8 is a sectional view of an alternative embodiment of the present invention taken along line A-A in FIG. 3.
Figure 9:
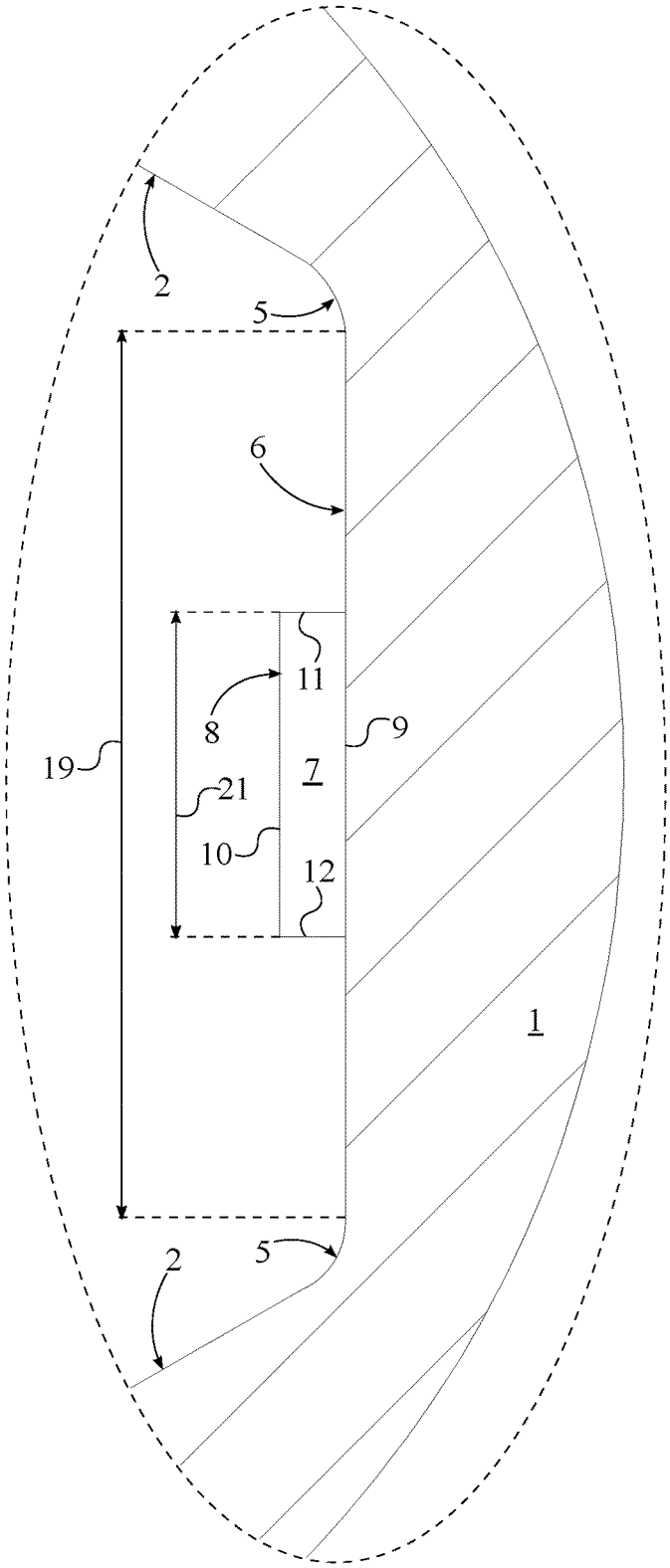
FIG. 9 is a detailed view of the alternative embodiment of the present invention taken about the oval X in FIG. 8.
Figure 10:
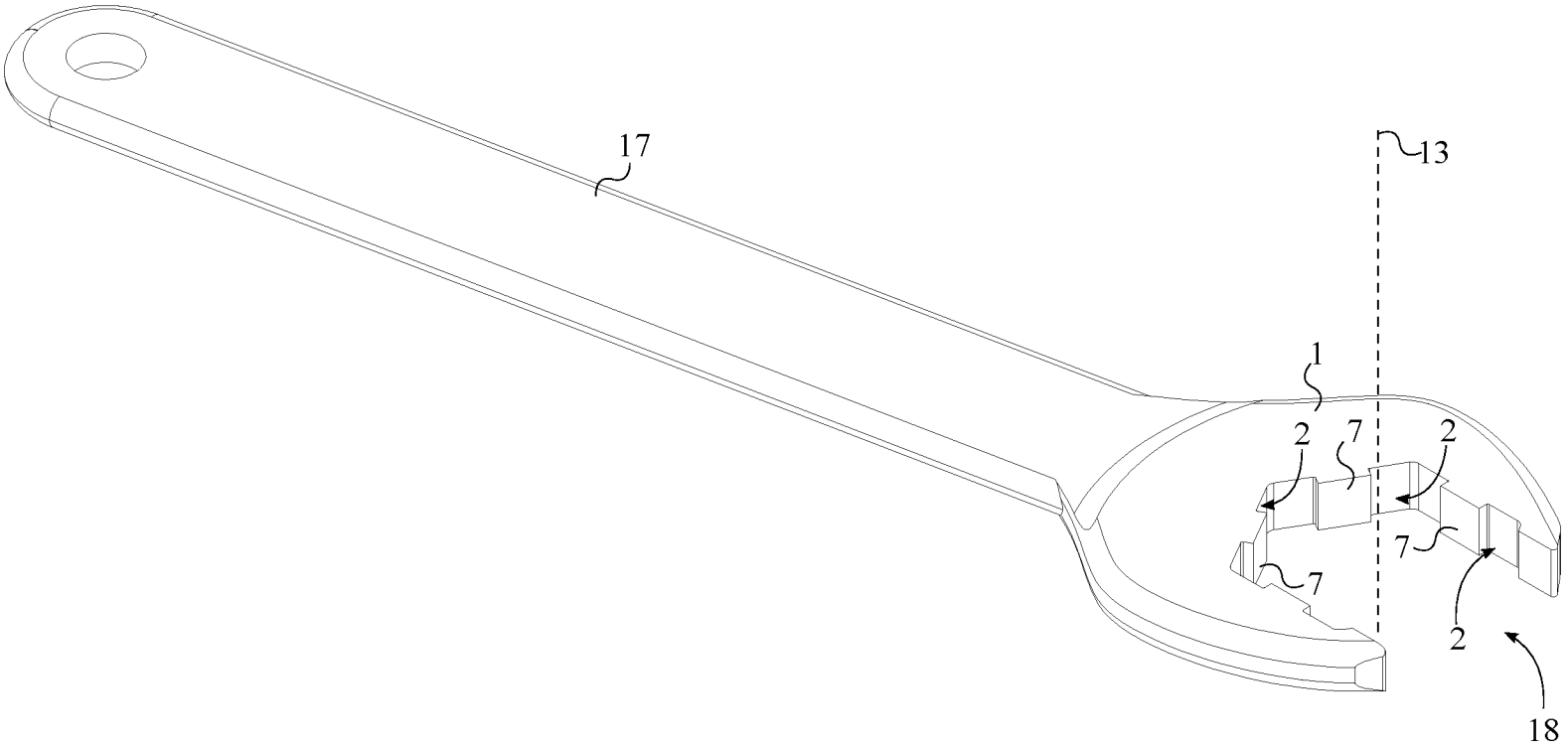
FIG. 10 is a perspective view of an alternative embodiment of the present invention.

Referring to FIG. 8 and FIG. 10, in one embodiment of the present invention, the quadrilateral shape is more specifically a rectangular shape. In particular, the first leg line 11 is oriented perpendicular with the corresponding sidewall 6, and the second leg line 12 is oriented perpendicular with the corresponding sidewall 6 to yield the rectangular shape as seen in FIG. 9. The rectangular shape decreases pressure points in order to increase longevity for the present invention.

As mentioned above, the present invention may be designed to fit a variety of fastener designs. This is achieved by varying the number within the plurality of engagement teeth 7 and the number within the plurality of internal sidewalls 2 to compliment different types of fastener designs. The number within the plurality of engagement teeth 7 and the plurality of internal sidewalls 2 correspond to the number of sides of the fastener head. For instance, for a pentagon-shaped fastener, there are five elements within the plurality of engagement teeth 7 and the plurality of internal sidewalls 2.

Figure 2:
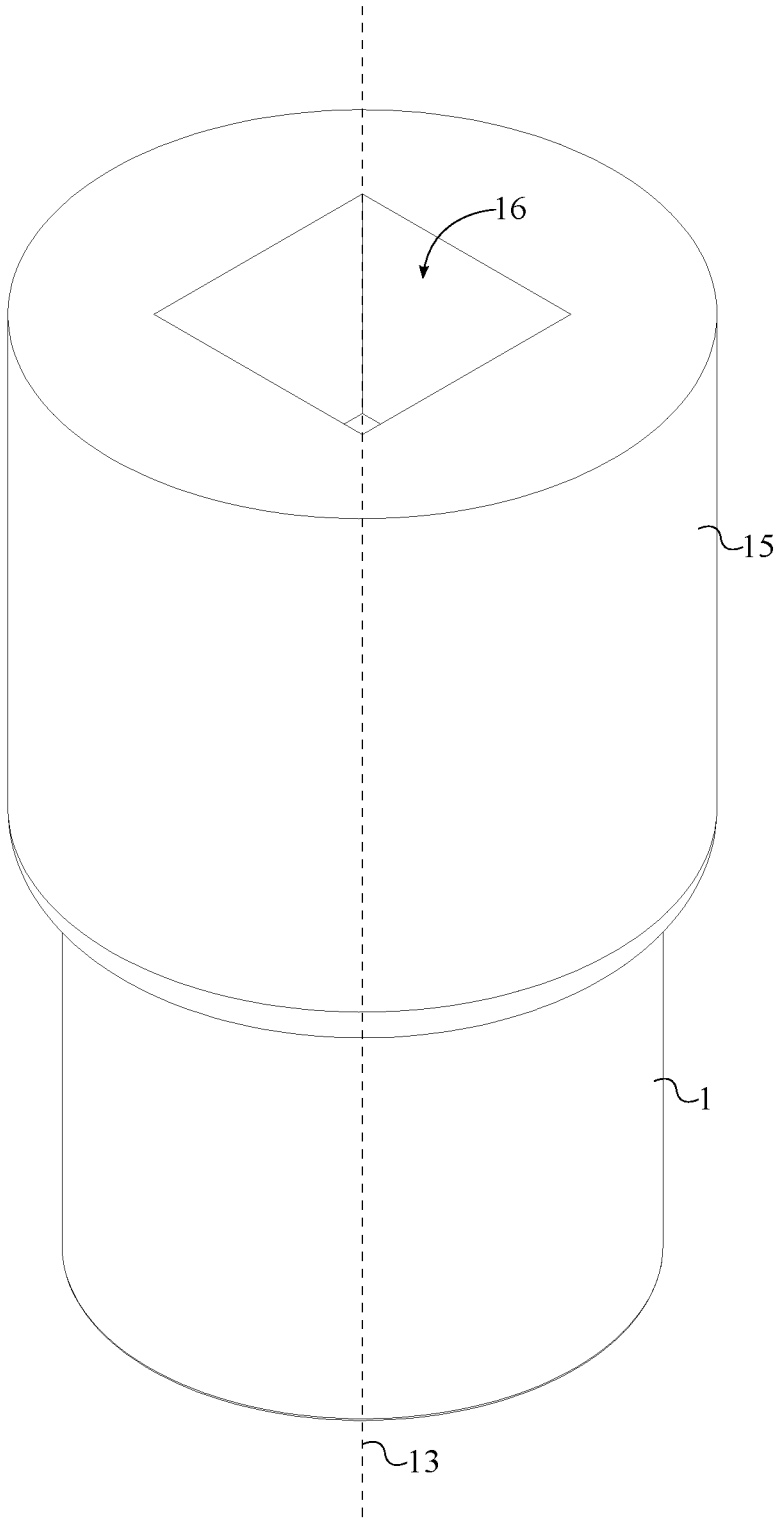
FIG. 2 is a bottom perspective view of the present invention.
Figure 3:
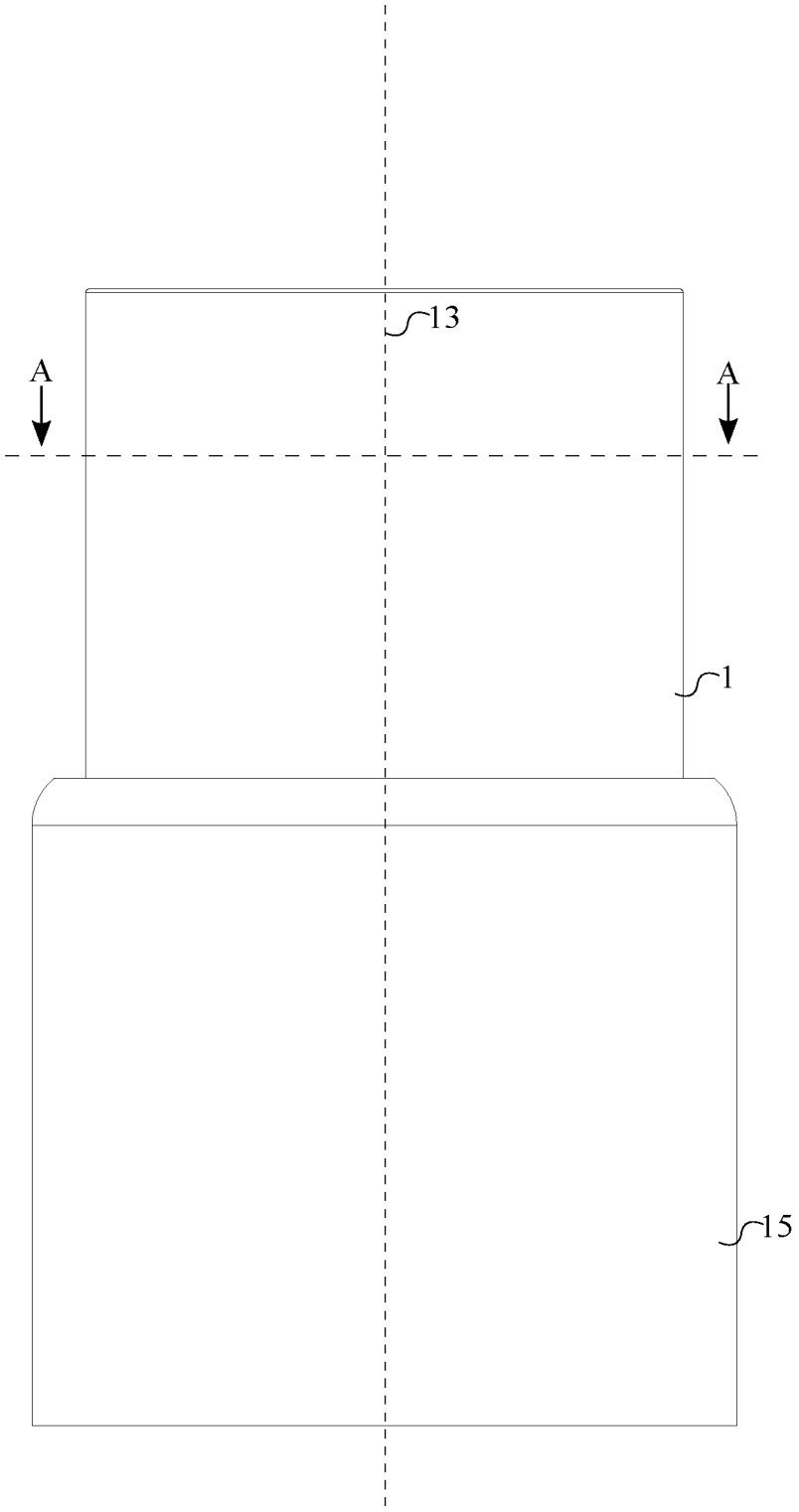
FIG. 3 is a side-view of the present invention.

In one embodiment, the present invention further comprises an attachment feature which allows an external torque tool to attach to the wrench-type torque-tool body 1 and increase the torque force applied to the fastener. In general, in this embodiment, the present invention is an alternative design for a wrench socket. Referring to FIG. 1, the present invention further comprises a cylindrical attachment body 15 and an engagement bore 16 that allows an external torque tool such as a ratchet handle to be attached to the wrench-type torque-tool body 1. The cylindrical attachment body 15 is centrally positioned around and along the pivot axis 13 in order to align with the axis of rotation of the external torque tool. Additionally, the cylindrical attachment body 15 is connected adjacent to the wrench-type torque-tool body 1 as seen in FIG. 2. In this embodiment, the wrench-type torque-tool body 1 is preferably of a tubular design and a diameter of the cylindrical attachment body 15 is preferably slightly larger than a diameter of the wrench-type torque-tool body 1. The engagement bore 16 traverses into the cylindrical attachment body 15 along the pivot axis 13, opposite the wrench-type torque-tool body 1. The engagement bore 16 is shaped to receive a male attachment member of the external torque tool; the preferred shape is square as the majority of external torque tools utilize a square attachment member. In alternative embodiments, the shape and design of the engagement bore 16 and the cylindrical attachment body 15 may vary to be adaptable to different external torque tools and different attachment means.

In another embodiment of the present invention, the wrench-type torque-tool body 1 is directly integrated into a torque tool, a typical closed wrench design more specifically. Referring to FIG. 6, the present invention further comprises a wrench handle 17. The wrench handle 17 is peripherally connected to the wrench-type torque-tool body 1 and acts as a lever arm to substantially increase the torque force applied to the fastener. The length of the wrench handle 17 may vary depending on the torque force required; a longer wrench handle 17 produces a greater torque force and vice versa. Furthermore, the general shape, design, and material composition of the wrench handle 17 may also vary to accommodate the needs of the user. For example, the wrench handle 17 may be padded at various regions to alter the handling characteristics of the tool to increase ease of use and comfort for the user. Additionally, the present invention may further comprise a fastener-receiving hole 18 to yield a typical open-end wrench design. The fastener-receiving hole 18 traverses through the wrench-type torque tool body, perpendicular to the pivot axis 13. Additionally, the fastener-receiving hole 18 is positioned opposite the wrench handle 17, across the wrench-type torque-tool body 1. The fastener-receiving hole 18 allows the user to reach fasteners in tight spots where there is not enough space to adequately maneuver the present invention.

Additionally, the plurality of internal sidewalls 2 comprises an arbitrary sidewall 3 and an adjacent sidewall 4, wherein the arbitrary sidewall 3 represents any one of the plurality of internal sidewalls 2 and the adjacent sidewall 4 represents the sidewall directly next to the arbitrary sidewall 3. It is preferred that the arbitrary sidewall 3 is adjacently adjoined to the adjacent sidewall 4 by a curved corner 5.

Although the invention has been explained in relation to its preferred embodiment, it is to be understood that many other possible modifications and variations can be made without departing from the spirit and scope of the invention as hereinafter claimed.

What is claimed is:

1. An anti-slip wrench-type tool comprising:
a wrench-type torque-tool body;
the torque-tool body comprising a plurality of internal sidewalls and a plurality of engagement teeth;
the plurality of internal sidewalls being radially distributed about a pivot axis of the wrench-type torque-tool body;
each of the plurality of engagement teeth being adjacently connected to a corresponding sidewall from the plurality of internal sidewalls;
a prismatic altitude for each of the plurality of engagement teeth being aligned parallel to the pivot axis;
each of the plurality of engagement teeth being oriented towards the pivot axis;
a cross section for each of the plurality of engagement teeth being a quadrilateral shape;
a first base line of the quadrilateral shape being positioned coincident with the corresponding sidewall;
a second base line of the quadrilateral shape being positioned parallel and offset to the first base line;
the quadrilateral shape tapering from the second base line towards the first base line;
a first leg line of the quadrilateral shape being at a first acute angle with the corresponding sidewall;
a second leg line of the quadrilateral shape being at a second acute angle with the corresponding sidewall;
the first leg line and the second leg line being oriented towards each other;
the plurality of internal sidewalls comprising an arbitrary sidewall and an adjacent sidewall;
the arbitrary sidewall being adjacently adjoining to the adjacent sidewall by a curved corner; and
a length of the corresponding sidewall and a length of the second base line being at a ratio of 3:1 with each other.

2. The anti-slip wrench-type tool as claimed in claim 1 further comprising:
a length of the first base line and the length of the second base line being at a ratio of 1.1:1 with each other.

3. The anti-slip wrench-type tool as claimed in claim 1 further comprising:
each of the plurality of engagement teeth being centrally positioned to the corresponding sidewall.

4. The anti-slip wrench-type tool as claimed in claim 1 further comprising:
a cylindrical attachment body;
an engagement bore;
the cylindrical attachment body being centrally positioned around and along the pivot axis;
the cylindrical attachment body being connected adjacent to the wrench-type torque-tool body; and
the engagement bore traversing into the cylindrical attachment body along the pivot axis, opposite the wrench-type torque-tool body.

5. The anti-slip wrench-type tool as claimed in claim 1 further comprising:
a wrench handle; and
the wrench handle being peripherally connected to the wrench-type torque-tool body.

6. The anti-slip wrench-type tool as claimed in claim 5 further comprising:
a fastener-receiving hole;
the fastener-receiving hole traversing through the wrench-type torque-tool body, perpendicular to the pivot axis; and
the fastener-receiving hole being positioned opposite the wrench handle, across the wrench-type torque-tool body.

7. An anti-slip wrench-type tool comprising:
a wrench-type torque-tool body;
the torque-tool body comprising a plurality of internal sidewalls and a plurality of engagement teeth;
the plurality of internal sidewalls being radially distributed about a pivot axis of the wrench-type torque-tool body;
each of the plurality of engagement teeth being adjacently connected to a corresponding sidewall from the plurality of internal sidewalls;
a prismatic altitude for each of the plurality of engagement teeth being aligned parallel to the pivot axis;
each of the plurality of engagement teeth being oriented towards the pivot axis;
a cross section for each of the plurality of engagement teeth being a quadrilateral shape;
a first base line of the quadrilateral shape being positioned coincident with the corresponding sidewall;
a second base line of the quadrilateral shape being positioned parallel and offset to the first base line;
the quadrilateral shape tapering from the second base line towards the first base line;
a first leg line of the quadrilateral shape being at a first acute angle with the corresponding sidewall;
a second leg line of the quadrilateral shape being at a second acute angle with the corresponding sidewall;
the first leg line and the second leg line being oriented towards each other;
the plurality of internal sidewalls comprising an arbitrary sidewall and an adjacent sidewall;
the arbitrary sidewall being adjacently adjoining to the adjacent sidewall by a curved corner;
a length of the corresponding sidewall and a length of the second base line being at a ratio of 3:1 with each other.

8. The anti-slip wrench-type tool as claimed in claim 7 further comprising:
each of the plurality of engagement teeth being centrally positioned to the corresponding sidewall.

9. The anti-slip wrench-type tool as claimed in claim 7 further comprising:
a cylindrical attachment body;
an engagement bore;
the cylindrical attachment body being centrally positioned around and along the pivot axis;
the cylindrical attachment body being connected adjacent to the wrench-type torque-tool body; and
the engagement bore traversing into the cylindrical attachment body along the pivot axis, opposite the wrench-type torque-tool body.

10. The anti-slip wrench-type tool as claimed in claim 7 further comprising:
a wrench handle; and the wrench handle being peripherally connected to the wrench-type torque-tool body.

11. The anti-slip wrench-type tool as claimed in claim 10 further comprising:

a fastener-receiving hole;

the fastener-receiving hole traversing through the wrench-type torque-tool body, perpendicular to the pivot axis; and the fastener-receiving hole being positioned opposite the wrench handle, across the wrench-type torque-tool body.

* * * * *